US005108052A

United States Patent [19]

Malewicki et al.

[11] Patent Number: 5,108,052

[45] Date of Patent: Apr. 28, 1992

[54] PASSENGER TRANSPORTATION SYSTEM FOR SELF-GUIDED VEHICLES

[76] Inventors: Douglas J. Malewicki, 14962 Merced Cir.; Frank J. Baker, 3881 Banyan St., both of Irvine, Calif. 92714

[21] Appl. No.: 702,608

[22] Filed: May 17, 1991

[51] Int. Cl.[5] ..... B61L 27/00

[52] U.S. Cl. ..... 246/5; 104/88

[58] Field of Search ..... 104/28, 88, 118; 105/1.1, 141; 235/381, 384; 364/407; 246/2 E, 2 F, 2 S, 3, 4, 5, 6, 122 R

[56] References Cited

U.S. PATENT DOCUMENTS

| | | | |
|---|---|---|---|
| 2,976,820 | 5/1955 | Schaar | 105/1.1 X |
| 3,106,898 | 10/1962 | Prosin | 104/130 |
| 3,122,105 | 2/1964 | Scherer | 105/147 |
| 3,147,714 | 9/1964 | Appelt et al. | 105/145 |
| 3,263,625 | 8/1966 | Midis et al. | 104/88 |
| 3,352,254 | 4/1965 | Lauber | 105/145 |
| 3,426,703 | 2/1969 | Morris | 105/145 |
| 3,543,007 | 10/1962 | Brinker et al. | 246/2 E X |
| 3,590,743 | 7/1971 | Larson | 104/130 |
| 3,606,839 | 9/1971 | Stafford et al. | 104/119 |
| 3,610,160 | 10/1971 | Alimanestianu | 104/88 |
| 3,610,162 | 10/1971 | Lawrence | 104/118 |
| 3,937,147 | 2/1976 | Szent-Miklosy, Jr. | 104/88 X |
| 3,942,450 | 3/1976 | Bordons Elorza | 104/121 |
| 4,018,410 | 4/1977 | Renaux | 246/5 |
| 4,023,753 | 5/1977 | Dobler | 246/5 |
| 4,237,790 | 12/1980 | DeLucia | 104/130 |
| 4,632,038 | 12/1986 | Lawrence | 104/120 |
| 4,690,064 | 9/1987 | Owen | 104/28 X |
| 4,791,871 | 12/1988 | Mowll | 104/88 X |
| 4,984,156 | 1/1991 | Mekata | 364/407 |
| 5,063,857 | 11/1991 | Kissel, Jr. | 104/88 |

*Primary Examiner*—Robert J. Spar
*Assistant Examiner*—Scott L. Lowe

[57] ABSTRACT

A transportation system for moving passengers comprising a plurality of terminals interconnected by a track network, upon which are supported a plurality of independent and individual self-guided vehicles. Each terminal has a plurality of Automated Ticketing machines (ATMs) for automated bank account or credit line debiting and for producing passenger tickets with coded destination information. Each vehicle has a body for carrying up to two passengers, wheels for supporting and moving the vehicle, driving and braking means, a wireless data link, and a Vehicle Control and Data Processing Computer (VCDPC). Each VCDPC reads the coded destination information on a passengr's ticket, computes a travel route, controls the driving and braking means, and stores operating data. Each vehicle also has mounted thereto an Identification and scanning Device (ISD), carrying vehicle identity information and operating under the control of the VCDPC. Other ISDs are positioned at a number of fixed locations in the track network and carry unique location identity information. Vehicle mounted ISDs are capable of detecting and reading the ISDs at each fixed location when in close proximity thereto, thereby providing vehicle location and direction of movement information to the VCDPC. A Master Contorl and Data Processing Computer (MCDPC), location at a fixed fixed, has a wireless data link to access all VCDPCs to obtain the travel route and current location of each vehicle and to issue vehicle commands. The MCDPC is also interconnected with each ISD at a fixed location in the track network in order to obtain backup data revealing the location of all vehicles. The MCDPC is also interconnected with each ATM at each terminal to obtain passenger travel demand data, to computer an optimal travel route for all vehicles in use, and to route vehicles that are not currently is use to terminals having higher passenger demand.

7 Claims, 2 Drawing Sheets

PASSENGER TRANSPORTATION SYSTEM FOR SELF-GUIDED VEHICLES

FIELD OF THE INVENTION

This invention relates to transportation systems. More particularly, this invention relates to rapid transit systems for self-guided rail-bound vehicles.

BACKGROUND OF THE INVENTION

Transportation is a critical element in the smooth and efficient operation of almost every aspect of today's cities and urban areas. As a result, many types of transportation systems have been developed to move people and cargo from one place to another more efficiently. The most prominent transportation systems are automobiles and trucks, both operating on public highways. Public buses utilize the same highway network, as do, to some extent, cable cars and electric buses. Subways, monorails, and trains, however, utilize a rail network that is typically less developed than the surrounding highway networks. Other forms of inter-city transportation, such as the bicycle, boat, and so forth, are less prominent.

Transportation systems can be evaluated on key factors such as energy efficiency, maximum capacity, capital equipment and construction costs, land usage, environmental costs, maintenance costs, and convenience to the user. While the more important of these factors from a global perspective must be cumulative environmental and energy costs, all too often the individual user identifies convenience as his most important factor. Consequently, while the automobile has significant environmental and efficiency drawbacks, it is overwhelmingly the most convenient transportation system in that it allows the automobile user to leave when he desires and to travel to any desired destination along any of several routes as fast as legally possible, potentially without interruption. Even many negative aspects associated with use of the automobile, such as traffic, pollution, the stress of driving, insurance costs, fuel costs, automotive maintenance and purchase costs, driving risks, and the like, do not outweigh the inconveniences associated with other forms of transportation. As a result, the automobile and highway network remain the most prominent transportation system in modern society.

Much attention has recently been focused on carpooling, or the sharing of one vehicle for several people who have the same destination or origin. While carpooling is a partial solution to some of the problems associated with the automobile, the most significant drawback with carpooling is that each person in a carpool must be ready to depart at a particular time. This limits the flexibility of the carpool system and the freedom of the carpool participants, and consequently reduces the number of carpool participants.

Public buses also utilize the highway network, but are far less popular than automobiles. Buses are less favored than automobiles because one must often wait at a bus stop for a relatively long period of time and in potentially disagreeable weather. Further, buses are generally restricted to particular routes, and consequently a bus rider must walk, or acquire other transportation, to and from bus stops along various routes proximate to his origination and destination. Frequently, transfers must be made from one bus to another due to inadequate routes, and frequent interim stops must be made to load or unload other passengers. Still further, buses are subject to many of the same drawbacks as the automobile, such as traffic, stop lights, and traffic risk. As a result, buses are not as popular as the automobile even though, when properly utilized, buses are more efficient and less environmentally harmful than the cumulative effect of so many individual automobiles.

Rail-guided vehicles, such as trains, monorails, and subways, are an alternative transportation system found in many cities and urban areas. When properly utilized, such systems are more energy efficient than automobiles and less environmentally damaging. However, many of the same drawbacks exist for rail guided vehicles as for busses. For example, railguided vehicle users are dependent upon predetermined and often inadequate schedules, a limited number of fixed routes, and lost time due to stops at intermediate stations for other passengers. Even the relatively high speeds attained by rail-guided vehicles do not fully compensate for the time lost in other ways when using such transportation systems.

Consequently, cities and urban areas have been plagued by the problems associated with having private automobiles as the primary mode of civilian transportation. A person will readily spend hours in heavy traffic either because there is no alternative, or because any available alternatives require more time and inconvenience. Moreover, the pollution created by millions of private automobiles is having an unmeasurable effect on the environment and quality of civilian life, not only in urban areas but in the surrounding rural areas as well. The cumulative energy wasted at stop lights and in traffic is considerable, and causes a direct increase in fuel costs and other costs associated with automotive transportation. The energy required to accelerate an automobile that weighs several thousand pounds is frequently converted into little more than friction within the automobile's braking system at the next traffic light. This is a considerable amount of wasted energy since the average human occupant in a typical automobile represents a mere 5% of the gross vehicle weight. Still further, dependence upon extremely large amounts of fossil fuels to power a large automotive transportation system makes such a society somewhat vulnerable to the whims of those who posses fossil fuel reserves.

Clearly, then, there is a need for a civilian transportation system that is able to compete with the automobile in terms of convenience to the user, but does not require the tremendous energy consumption of an automotive transportation system. Further, such an improved transportation system should provide increased safety expectations, less overall cost to the user, and profitability to those manufacturing, owning, operating such a system. The present invention fulfills these needs and provides further related advantages.

SUMMARY OF THE INVENTION

The present invention is a mono-rail transportation system for moving passengers and cargo. A number of terminals, each having a plurality of automated ticketing machines (ATM) for producing passenger tickets with coded destination information and for automated bank account or credit card debiting, allow passengers access to the transportation system. A track network, the terminals being located at various points thereon, supports a relatively large number of self-guided vehicles, each vehicle moving independently and individually over the track network.

Each vehicle comprises an aerodynamically streamlined body for carrying one or two passengers, wheels for supporting and moving the vehicle along the track network, driving and braking means connected to the wheels, a wireless data link, and a Vehicle Control and Data Processing Computer (VCDPC). The VCDPC reads the coded destination information from the passenger's ticket, computes a travel route along the track network, controls the driving and braking means, stores operating data, and displays this operating data on a liquid crystal display device within the body of the vehicle so that the passenger can monitor the vehicle's progress along the computed route. Further, a passenger control means is included so that a passenger may change the destination or route from within the vehicle, or stop the vehicle in case of an emergency. The driving and braking means preferably includes a velocity control means enabling all vehicles that are in use to move at a previously established common velocity. Moreover, a radar detection means is included for avoiding collision with another vehicle. This detection means determines vehicle spacing by measuring both the time for a radar burst to travel between the vehicles and back, and the closing rate by calculating the first derivative of the vehicle spacing with respect to time.

One of a plurality of Identification and Scanning Devices (ISD) is mounted on each vehicle, carries unique vehicle identity information, and operates under the control of the VCDPC with an optical method of scanning. Other ISDs are positioned at fixed locations along the track network and carry unique location identity information. Each vehicle-mounted ISD is capable of detecting an ISD along the track network when in close proximity thereto, thereby providing vehicle location and direction of movement information to the VCDPC on the vehicle.

A Master Control and Data Processing Computer (MCDPC), located at a fixed site, has a wireless data link to access all VCDPCs to obtain the travel route and current location of each vehicle. The MCDPC is interconnected with each ISD along the track network in order to obtain backup data revealing the location of all vehicles. The MCDPC is also interconnected with all ATMs to obtain passenger travel demand data, to compute an optimal travel route for all vehicles in use, and to route the vehicles which are not currently in use to terminals having higher passenger demand.

In operation, a passenger may enter the transportation system through any terminal, purchase a ticket from an ATM by indicating a desired destination to the ATM and by supplying a method of payment, enter a waiting vehicle, input the destination information into the VCDPC, and wait while the vehicle transports the passenger to the destination over the track network. After the passenger leaves the vehicle, the vehicle either waits at that terminal for another passenger or is directed by the MCDPC to another terminal with higher passenger demand.

The present invention succeeds in providing an efficient transportation system since each vehicle may obtain its electrical power requirements from electrodes in the track, or an additional rail, eliminating the need for vehicle mounted batteries or engines. Moreover, due to significant decreases in the collision risk between vehicles in such a system, heavy construction for passenger safety of the vehicle is unnecessary, further reducing the weight of each vehicle. As a result, a typical human passenger may represent close to 50% of the gross vehicle weight, dramatically reducing the energy requirements of the vehicle and the system as a whole.

Further, passenger and pedestrian safety is substantially increased in the present invention as each vehicle may be locked to a T-shaped track or equivalent, minimizing derailment risk. The track network may be designed in such a way as to minimize the risk of cross traffic collisions by, for example, allocating different track elevations to traffic traveling in each of four directions, while utilizing automatically cooperating "clover-leaf" type interchange tracks for 90° route turns. By supporting this track network significantly above the ground, the threat of cross traffic and head-on collisions with other vehicles is also minimized, as is the threat of hitting pedestrians. Moreover, because of the relatively low inertial mass of a vehicle of the present invention, less time and distance is required for vehicle acceleration and deceleration, further increasing the safety of the passengers in such vehicles in the event that a sudden stop or sudden acceleration of the vehicle is mandated by the VCDPC or MCDPC.

Preferably, track networks are supported above existing highways and as a result require little more land than is already allocated for such highways. Terminals are numerous enough to be convenient for most passengers, and there are always vehicles not currently in use at any given terminal, ready to depart on demand, independent of any predetermined schedule. Construction costs of such a transportation system are significantly less than the cost of building current highways, and the capacity of such a transportation system relative to land usage is significantly greater due to the relatively high vehicles speeds and relatively low space requirements. Thus, with a sufficient track network, such a transportation system can be nearly as convenient as an automobile. Further, a passenger does not have to monitor the actions of the vehicle as they are automated by the VCDPC, reducing the traffic-related stress level of a passenger once his trip is underway.

Other features and advantages of the present invention will become apparent from the following more detailed description, taken in conjunction with the accompanying drawings, which illustrate, by way of example, the principles of the invention.

DESCRIPTION OF THE DRAWINGS

The accompanying drawings illustrate the invention. In such drawings.

DETAILED DESCRIPTION OF THE PREFERRED EMBODIMENT

Figure 1:
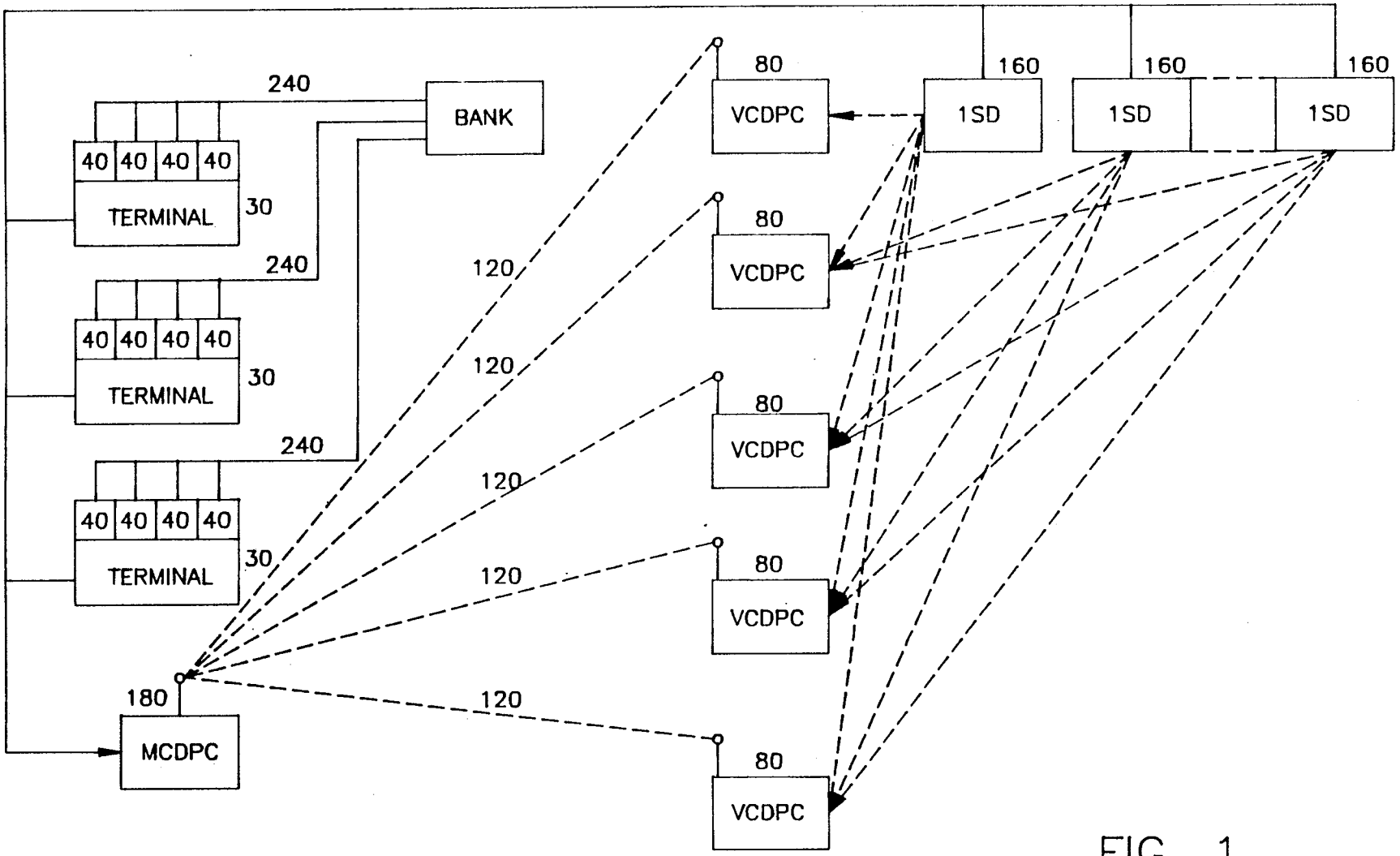
FIG. 1 is a schematic representation of the elements of the invention.
Figure 2:
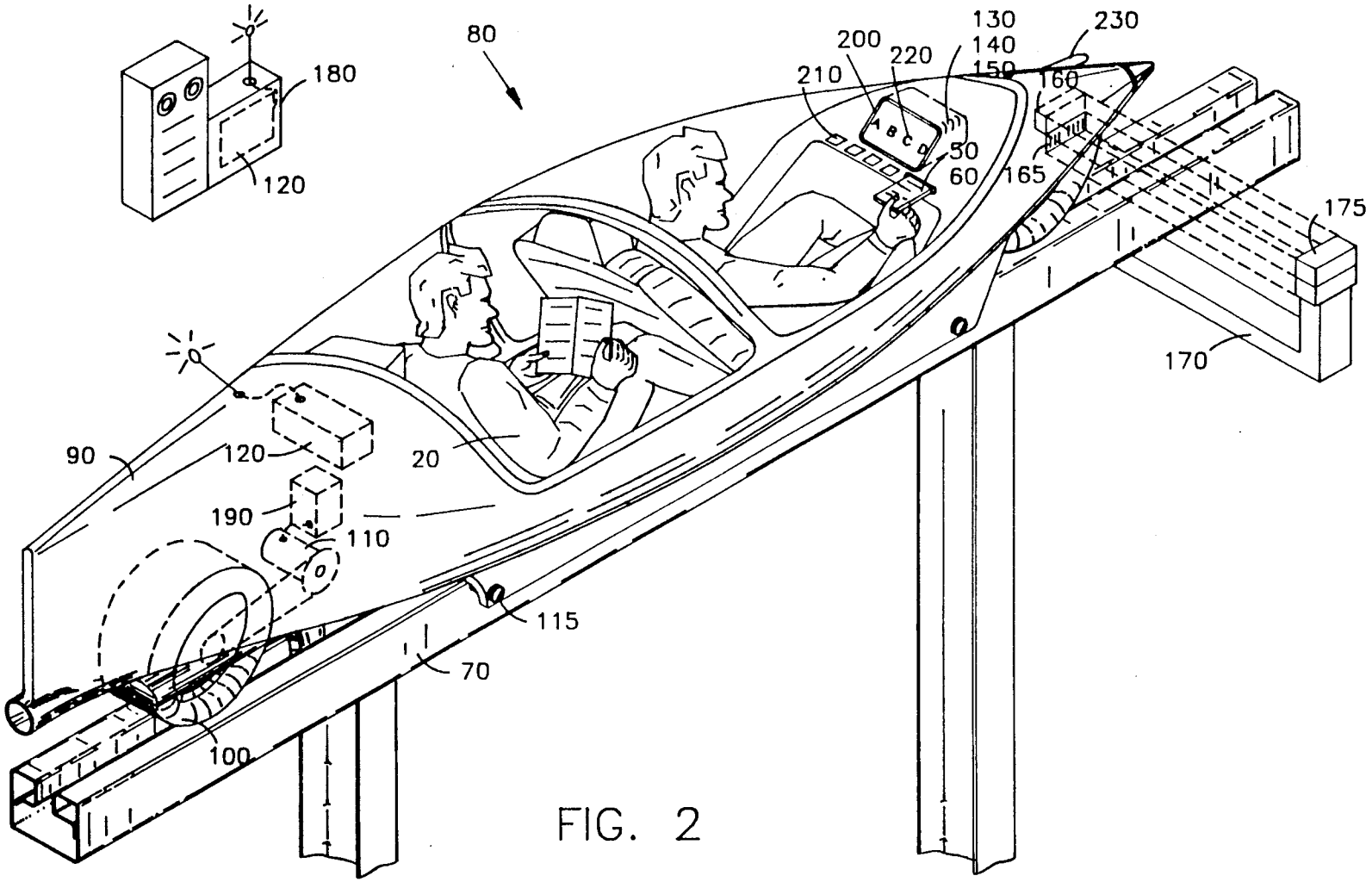
FIG. 2 is a perspective illustration of a vehicle of the invention shown traveling along a partial section of a track network.

FIGS. 1 and 2 illustrate a transportation system 10 for moving passengers 20 and cargo (not shown). A plurality of terminals 30 for providing access of passengers 20 to the transportation system 10 each have a plurality of automated ticketing machines (ATMs) 40 for producing passenger tickets 50. Each ticket 50 has coded destination information 60 thereon in any suitable format, such as magnetically or optically read code. Preferably, each ATM 40 has automated bank account or credit card debiting means 240, such as those found on common automated teller machines for banks, and the like.

The terminals 30 are each interconnected by a track network (not shown), upon which are supported and guided a plurality of vehicles 80, the vehicles 80 all moving independently and individually over the track network. Each vehicle 80 has a body 90 for carrying one or two passengers 20, wheels 100 for supporting and moving the vehicle 80, a driving and braking means 110 for accelerating and decelerating the vehicle 80, a wireless data link 120 for transmitting and receiving information and commands, and a vehicle control and data processing computer (VCDPC) 130. Each VCDPC 130 reads the coded destination information 60 from the ticket 50, computes a travel route 140, controls the driving and braking means 110, and stores operating data 150. Preferably, each VCDPC 130 further includes a passenger information display 200, such as a liquid crystal display device 220 (FIG. 2) and a passenger control means 210 to change the destination or route from within the vehicle 80. The driving and braking means 110 preferably include a velocity control means 190 enabling all vehicles 80 that are in use to move at a previously established common velocity. Further, each vehicle 80 carries a radar detection means 230 for avoiding collision with another vehicle 80 by detecting vehicle spacing by measuring both the time for a radar burst to travel between two vehicles 80, and the closing rate by calculating the first derivative of the vehicle 80 spacing with respect to time.

One of a plurality of identification and scanning devices (ISDs) 160 are mounted on each vehicle 80, the vehicle-mounted ISDs 160 each carrying unique vehicle identity information 165 and operating under the control of the VCDPC 130. Each ISD 160, in the preferred mode of the invention, utilizes an optical method of scanning, such as a laser and bar code method. Other ISDs 160 are positioned at a plurality of fixed locations 170 in the track network and each carry unique location identity information 175. Each vehicle-mounted ISD 160 is capable of detecting and reading each ISD 160 at each fixed location 170 when in close proximity thereto, thereby providing vehicle location and direction of movement information to the VCDPC 130.

A master control and data processing computer (MCDPC) 180, located at a fixed site, has one wireless data link 120 to access all VCDPCs 130 in order to obtain the travel route and current location of each vehicle 80 and to issue commands to VCDPCs if necessary. The MCDPC 180 is interconnected with the ISD at each fixed location 170 in order to obtain backup data revealing the location of all vehicles 80. In addition, the MCDPC is interconnected with all ATMs 40 to obtain travel demand data of all passengers 20 purchasing tickets 50, to compute an optimal travel route 140 for all said vehicles 80 in use, and to route the vehicles 80 that are not currently in use to a terminal 30 having a higher passenger demand.

In operation, any one passenger 20 may enter the transportation system 10 through any one terminal 30, purchase a ticket 50 from an ATM 40 by indicating a desired destination to the ATM 40 and by supplying a payment method, enter one vehicle 80 not currently in use, input the destination information 60 into the VCDPC 130, and wait while the vehicle 80 transports the passenger 20 to the desired destination over the track network 70.

Preferably, the track network is a grid network (not shown), with tracks dedicated to eastward and westward traffic at a different elevation than tracks dedicated to northward and southward traffic, thereby reducing collision risks. Further, the VCDPC 130 and MCDPC 180 favor travel routes 140 with a minimum number of 90° turns, thereby reducing energy requirements associated with decelerations and accelerations for turns and minimizing collision risks for merging traffic. Merging of vehicles 80 onto a track section is preferably accomplished by accelerating each vehicle 80 to the previously established common velocity on an adjacent track in such a way that the vehicle 80 may switch to a through track (not shown) when a gap in traffic on the through track becomes available. Clearly, all tracks, track switching means, and vehicle-to-track attachment means may be of any suitable and currently available technologies.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A transportation system for moving passengers, comprising:

a plurality of terminals for providing access of said passengers to said transportation system, each said terminal having at least one automated ticketing machines (ATM) for producing passenger tickets having a coded destination information; the terminals being interconnected by;

a track network upon which are supported and guided;

a plurality of vehicles, each said vehicle having a body for carrying up to two said passengers, wheels for supporting and moving the vehicle, a means of driving and braking said wheels, a wireless data link, and a vehicle control and data processing computer (VCDPC) for reading said coded destination information, for computing a proposed travel route, for controlling said means for driving and braking, and for storing operating data, the vehicles all moving individually over the track network;

a plurality of identification and scanning devices (ISD), one of the ISD being mounted on each said vehicle for providing vehicle identity information under the control of said VCDPC, one of the ISD being positioned at each one of a plurality of fixed locations along said track network for providing location identity information, each said ISD being capable of detecting any other said ISD when in close proximity thereto, thereby providing a current location and direction of movement information to said VCDPC; and a master control and data processing computer (MCDPC) located at a fixed site, the MCDPC having said wireless data link to access all said VCDPC to obtain the proposed travel route and the current location of each said vehicle, the MCDPC being interconnected with the ISD which are at the fixed locations, to obtain location data of each said vehicle, the MCDPC being interconnected with all said ATM to obtain passenger travel demand data, to compute an optimal travel route for each said vehicle;

whereby at least one said passenger may enter said transportation system through any said terminal, purchase said ticket from said ATM after indicating a desired destination, enter one said vehicle, input said destination information into said VCDPC, and wait while said vehicle transports said passenger to said destination over said track network.

2. The transportation system of claim 1 wherein said means of driving and braking further include a means for velocity control enabling all said vehicles that are in use to move at a previously established common velocity.

3. The transportation system of claim 1 wherein said VCDPC further includes a means for passenger information display and a means for passenger control to change said destination.

4. The transportation system of claim 3 wherein said means for passenger information display includes a liquid crystal display device.

5. The transportation system of claim 1 wherein said identification and scanning devices use an optical method of scanning.

6. The transportation system of claim 1 wherein said vehicles each carry a radar detection means for avoiding collision with another said vehicle by detecting vehicle spacing by measuring the time for a radar burst to travel between said vehicles, and closing rate by calculating the first derivative of the vehicle spacing with respect to time.

7. The transportation system of claim 1 wherein said ATM has means for automated bank account or credit card debiting.

* * * * *